United States Patent [19]

Redfern

[11] 4,006,325

[45] Feb. 1, 1977

[54] OFFSET PIVOT GROUND SWITCH

[75] Inventor: Calvin E. Redfern, Portland, Oreg.

[73] Assignee: Allis-Chalmers Corporation, Milwaukee, Wis.

[22] Filed: Nov. 19, 1975

[21] Appl. No.: 633,420

[52] U.S. Cl. ..... 200/48 A
[51] Int. Cl.[2] ..... H01H 31/00
[58] Field of Search ..... 200/48 R, 48 A, 48 SB, 200/48 RB, 48 UR

[56] References Cited

UNITED STATES PATENTS 3,725,619 4/1973 McKinnon ..... 200/48 A

*Primary Examiner*—Herman J. Hohauser
*Attorney, Agent, or Firm*—Robert C. Jones

[57] ABSTRACT

An interphase support shaft is offset with respect to the rotation point to permit the shaft weight to serve as a counterbalance to the switch blade by locating its weight at a distance from the pivot point.

10 Claims, 4 Drawing Figures

OFFSET PIVOT GROUND SWITCH

CROSS-REFERENCE TO RELATED APPLICATIONS

Related applications pertinent to the present invention are not known to applicant.

BACKGROUND OF THE INVENTION

The invention relates to switch assemblies and more specifically to disconnect ground switches. In a disconnect ground switch the switch blades can be of considerable length which when moved from open position to closed requires considerable effort to effect the pivotal movement. As a result elaborate and expensive operating means have been necessary to provide the necessary closing effort. In addition current transfer between the rotating shaft and the switch blade usually has been accomplished by braided elements which become frayed and subject to field failure.

SUMMARY OF THE INVENTION

In accordance with the present invention, an interphase current transfer shaft is provided which also serves as an operating shaft for the disconnect grounding switch. The interphase shaft is offset relative to a rotation point wherein advantage of the shaft mass is taken to provide a counterbalance for the switch blades. As a result a vertical component of sliding friction between the blade and fixed contact results in low operating effort when the blade plug is in contact with the contact shoes. The hinge pin, offset from the interphase shaft, can be small and threaded for good current transfer eliminating braids and the additional manufacturing cost. In addition the couplings which provide for torque transfer between the shaft and the blade switch are provided with positive line contact grips which do not deform or weaken the shaft. The live contact permits fine adjustments to be made between the coupled members.

Accordingly, it is a general object of the present invention to provide an improved disconnect grounding switch structure having an improved interphase operating shaft arrangement.

Another object of the present invention is to provide an improved disconnect grounding switch structure in which the interphase operating shaft serves as a counterbalance for the blade switch.

Still another object of the present invention is to provide an improved coupling structure which provides line contact gripping.

Yet another object of the present invention is to provide an improved coupling structure which provides fine adjustment between the coupled members.

Further objects and advantages of the present invention will become more readily apparent upon consideration of the following description taken in conjunction with the drawings

DESCRIPTION OF THE INVENTION

Figure 1:
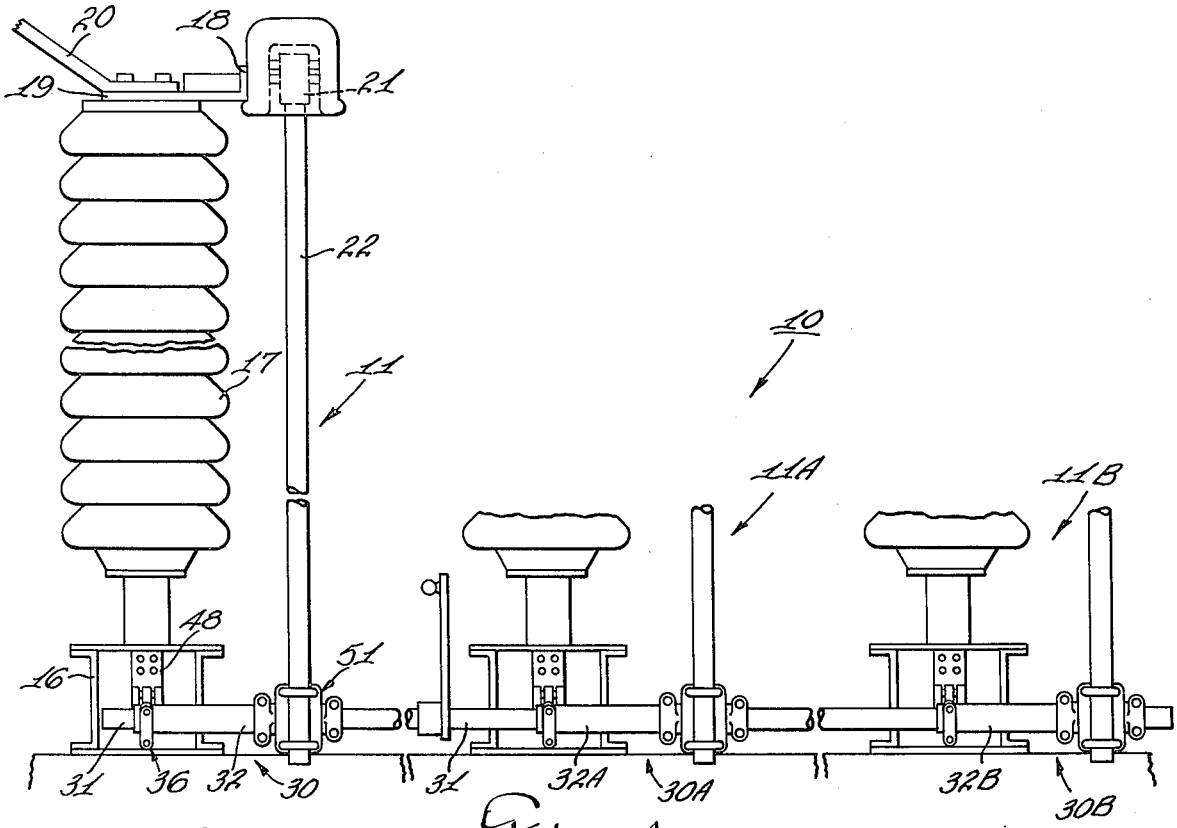
FIG. 1 is a fragmentary view in elevation of a three phase disconnect grounding switch installation incorporating the present invention.

A high voltage three phase disconnect grounding switch arrangement 10 is shown in FIG. 1. As shown the disconnect grounding switch arrangement comprises three identical phase assemblies 11, 11A and 11B. Thus, a description of the phase assembly 11 will apply equally as well to the phase assemblies 11A and 11B. As shown, the phase assembly 11 includes an upstanding insulator 17 associated with the phase assembly 11 and is fixedly supported on a base 16. At the uppermost end of the insulator 17 there is supported a fixed contact assembly 18 including a terminal pad 19 which is adapted to receive the usual power line 20. The contact assembly 18 is adapted to be engaged by the contact end 21 of an electrically conductive blade switch 22 of the assembly 11. In FIG. 1, the blade switch 22 is shown as it appears in a vertical closed position while in FIG. 4 the blade switch is depicted in its horizontal open position.

Figure 2:
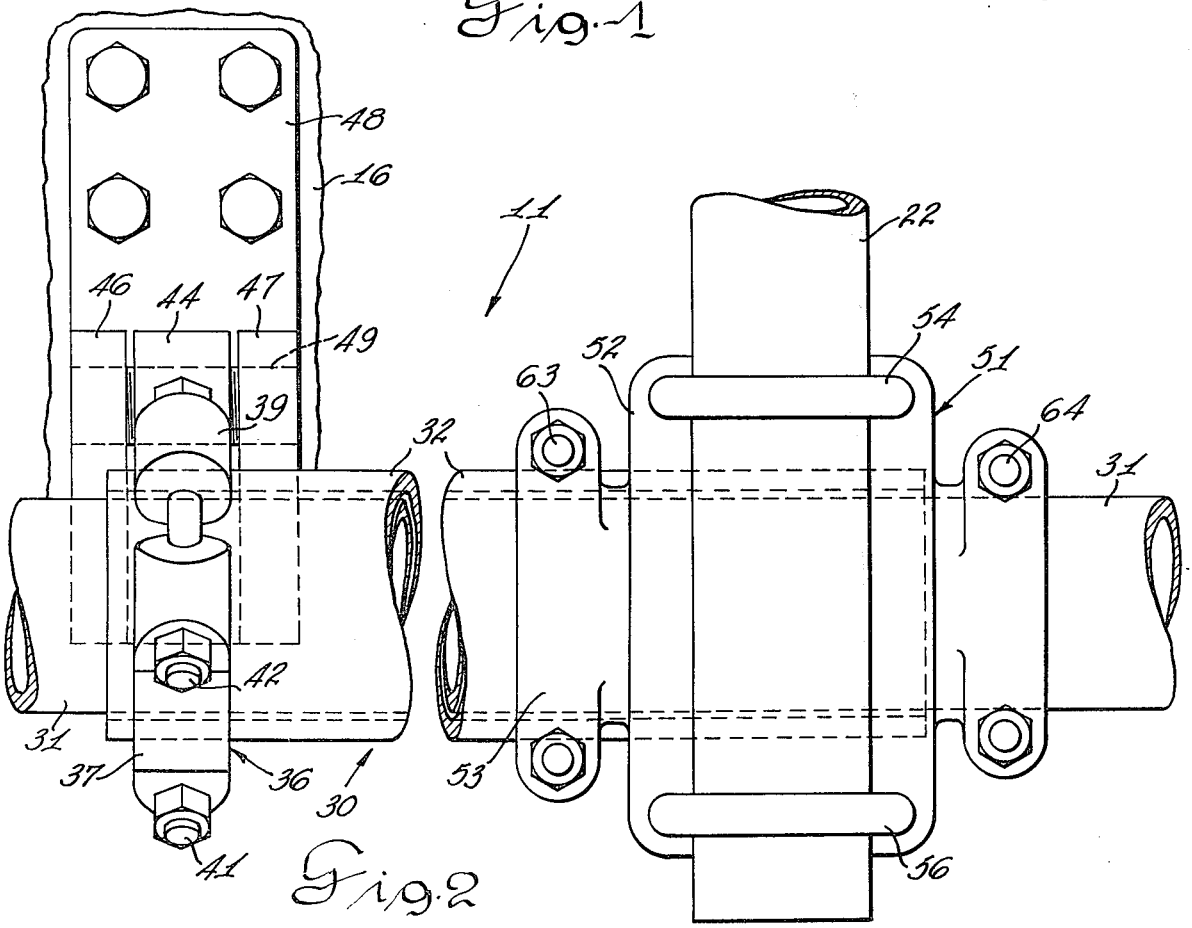
FIG. 2 is an enlarged view of the hinge and transfer tube and associated blade switch.
Figure 3:
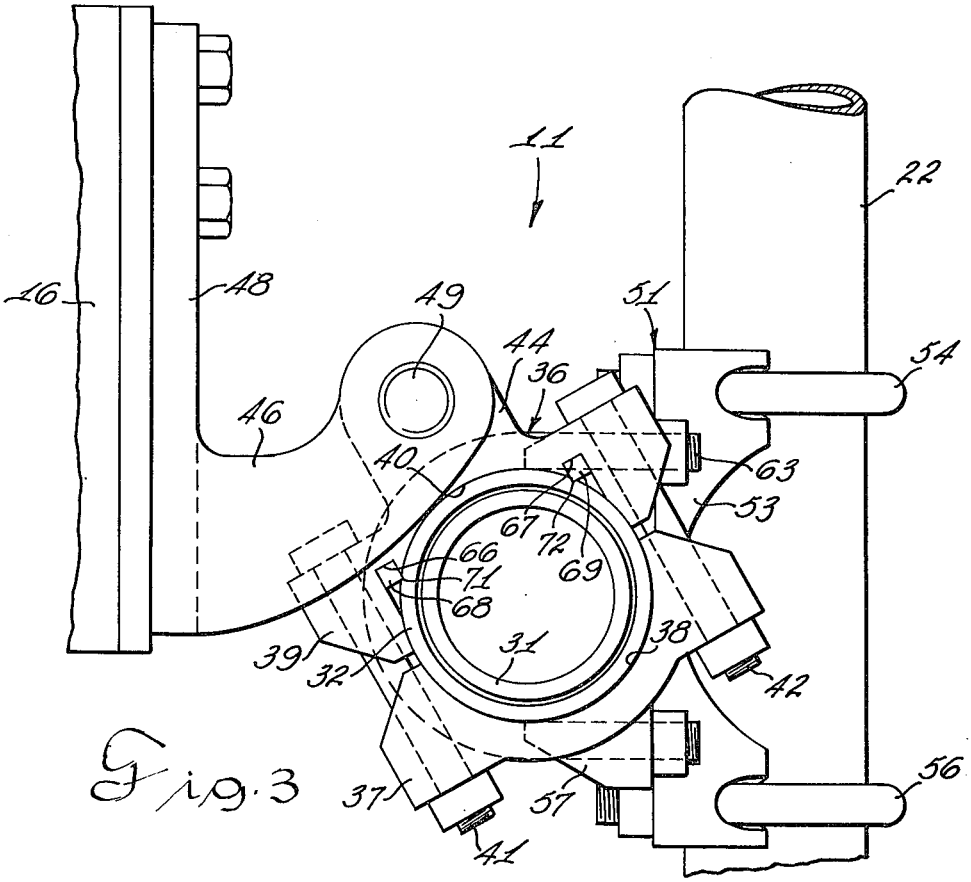
FIG. 3 is an enlarged detail end view of the interphase shaft, transfer tube and hinge arrangements as viewed from the left of FIG. 2.

Pivotal movement of the blade switch 22 between horizontal open position and vertical closed position is accomplished by means of a novel current transfer closing arrangement 30. The arrangement 30 comprises an interphase transfer shaft 31 which extends horizontally between the phase assemblies 11, 11A and 11B. For effecting pivotal movement of the blade switch 22 associated with the assembly 11 there is provided a transfer tube 32. To maintain the transfer tube 32 in operative position relative to the phase assembly 11 there is provided a hinge clamp 36. The hinge clamp 36 also serves as a support and movable pivot arm by which means the transfer tube 32 is made to pivot bodily in a blade switch closing and opening movement. To this end and, as shown in FIGS. 2 and 3, the hinge clamp 36 comprises a pillow block 37 having a contoured cradle 38 that is complementary to the curved surface of the transfer tube 32. A lever arm block 39 also having a contoured cradle 40 which is complementary to the curved surface of the transfer tube 32 is disposed on the tube 32 in bracketing relationship to the pillow block 37. Bolts 41 and 42 extend through the ends of the lever arm block 39 and the pillow block 37 to effectively clamp the transfer shaft 32 therebetween. The lever arm block 39 includes an outwardly extending arm 44 which is received between spaced apart arms 46 and 47 of a bracket 48. The bracket is bolted or otherwise secured to a vertical surface of the support 16. The arm 44 is connected between the bracket arms 46 and 47 by a threaded stud 49 which also serves as a threaded conducting joint. Thus, as the hinge clamp 36 is caused to pivot about the current carrying hinge pin or stud 49 the transfer tube 32 is moved bodily in an arcuate path of travel about the threaded stud 49.

Figure 4:
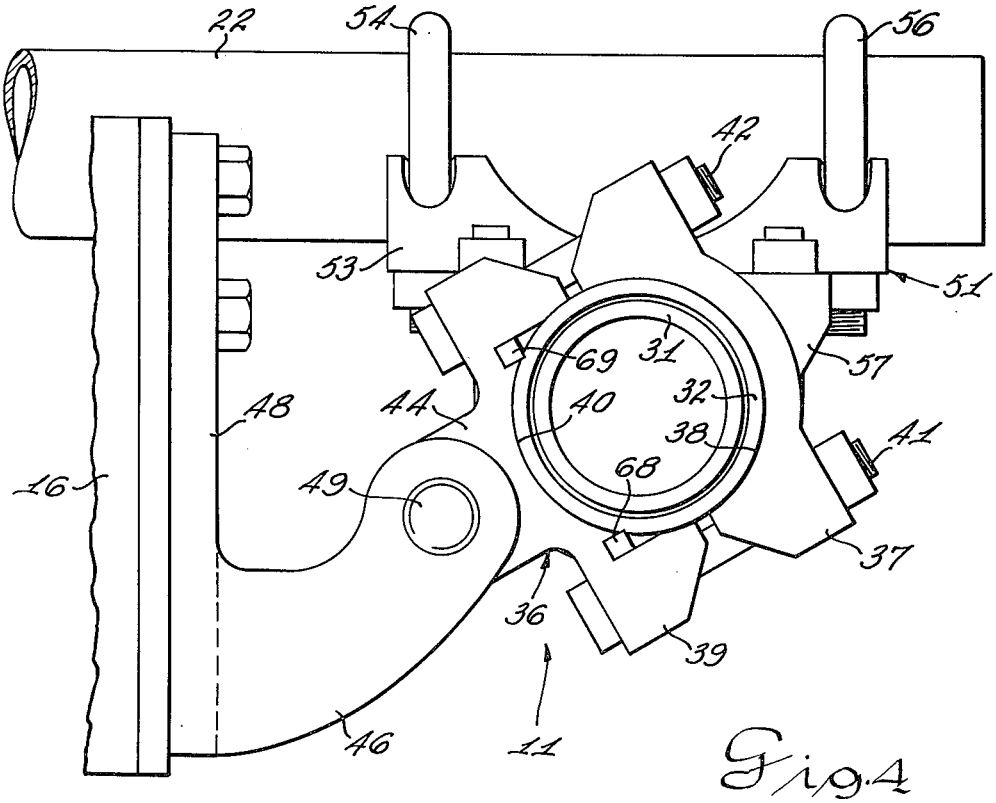
FIG. 4 is similar to FIG. 3 but shows the blade switch and associated hinge mechanism as they appear in blade switch open position.

As shown in FIGS. 2, 3 and 4, the blade switch 22 is secured to the transfer tube 32 in a manner to move bodily with the bodily movement of the transfer tube. To this end the lower end of the blade switch 22 is clamped to the right-hand end of the transfer tube 32 as viewed in FIGS. 1 and 2 by means of a double U-bolt clamp block 51. The double U-bolt clamp 51 itself comprises a first contoured cradle portion 53 which extends parallel to the direction in which the blade switch 22 extends. This first cradle portion 53 receives the blade switch 22 and the double U-bolts 54 and 56 engage around the blade switch and pass through the pillow block to clamp the blade switch in the first cradle 53. A second cradle portion 57 of the double U-bolt clamp 51 extends in a direction transverse to the direction in which the first cradle portion 53 extends. The second cradle portion 57 is adapted to be complementary to the curved surface of the transfer tube 32 so as to neatly mate therewith. A U-bolt 63 serves to effectively clamp the clamp block 51 to the electrically conductive transfer tube 32 position and maintain the blade switch 22 in operative position. Another U-bolt 64 effectively clamps the interphase transfer shaft 31 to the clamp block 51. Thus, a current path is established from the line conductor 20 through the terminal pad 19 and thence to the fixed contact assembly 18. From the fixed contact assembly 19 the current path continues through the blade switch 22 to the clamp 51 and thence to the aluminum transfer tube 32. The current path continues through the hinge clamp 36 and the current transfer pivot pin 49 to the bracket 48 and thence by a conductor (not shown) to a station ground grid (not shown).

As previously mentioned, the hinge clamp 36 must effectively engage with the surface to the transfer tube 32 in a manner to prevent the transfer tube 32 from shifting angularly relative to an established working position. This is true because any angular displacement of the transfer tube 32 will have an adverse effect on the position of the blade switch 22. For example, as viewed in FIG. 4, if the transfer tube 32 shifts angularly in a counterclockwise direction the position of the blade switch 22 will be displaced downwardly. Thus, under this condition, when the blade switch 22 is moved to a closed position it will not fully engage with the fixed contacts 18. Conversely, if the transfer tube 32 shifts angularly in a clockwise direction the blade switch 22 will be displaced angularly, as viewed in FIG. 3, to the right side of its vertical closed position. This position of the blade switch 22 would damage the fixed contact assembly 18 when the blade switch is moved to a closed position.

A similar condition exists with regard to the double U-bolt clamp 51 with respect to the transfer tube 32 and also with respect to the blade switch 22 itself.

To prevent accidental shifting of the associated members, a novel gripping arrangement has been provided in each of the clamp portions that have direct contact with either the transfer tube 32, the blade switch 22 or the interphase pipe 31. The gripping arrangement is the same in each clamp. Thus, the description of the gripping arrangement associated with the hinge clamp 36 will apply to the portions of the clamp 51 that are in engagement with either the transfer tube 32 or the blade switch 22 or the interphase pipe 31.

As shown in FIGS. 3 and 4, the lever arm block 39 of the hinge clamp 36 and the concave surface of the cradle portion 40 is provided with a pair of longitudinally extending spaced apart keyways 66 and 67. Elongated keys 68 and 69 are disposed within the keyways 66 and 67, respectively. As can be seen, the keys are constructed to present sharp corners so that with the keys within the respective keyways a sharp corner, such as a corner 71 of the key 68 and the corner 72 of the key 69, extend inwardly to sharply engage with the surface of the aluminum transfer tube 32. The line contact effected between the corners 71 and 72 of the keys 68 and 69, respectively, with the transfer tube 32 is of limited penetration so that the transfer tube 32 will not be damaged or deformed, but the biting action of the keys provides an excellent torque transfer arrangement. This arrangement is superior in results obtained over that of a piercing screw which would penetrate and deform the aluminum stock of the transfer tube. Also, with the key arrangement angular adjustment between the members can be readily accomplished in fine incremental steps.

From the foregoing description of the novel disconnect ground switch arrangement, it will be appreciated that the interconnection of the blade switch 22 through the transfer tube 32 with the hinge clamp 36 and the relationship of the interphase steel pipe 31 serves as a counterbalance for the blade. This is clearly evident in viewing FIGS. 3 and 4. With this arrangement less effort is required to effect the pivotal movement of the blade switch between its open and closed positions. The input effort to effect such pivotal movement is herein shown as being manual through a lever 76 that is fixedly secured to the steel interphase pipe 31.

The embodiments of the invention in which an exclusive property or privilege is claimed are defined as follows:

1. In a disconnect ground switch comprising three individual switch assemblies, one per phase;
   a frame;
   an insulator for each phase switch, said insulators being carried by said frame;
   a fixed contact carried by each insulator;
   an interphase support shaft extending between said phase switches, said interphase support shaft being carried by said frame for bodily movement about an axis;
   a blade switch for each phase switch, said blade switches being movable into and out of engagement with an associate, one of said fixed contacts;
   means operably connecting each blade switch to said interphase support shaft; and
   actuating means operably connected to effect bodily movement of said interphase support shaft bodily about said axis,
   whereby bodily movement of said interphase support shaft about said axis in one direction effects the bodily movement of said blade switches into engagement with said associated fixed contacts and the mass moving about the pivot axis serves as a counterbalance.

2. A disconnect switch according to claim 1 wherein said interphase support shaft is an iron pipe.

3. A disconnect switch according to claim 2 wherein blade switches are connected to said interphase support pipe at their noncontact ends,
   whereby the mass of the interphase support pipe serves as a counterbalance in relation to the axis about which said interphase pipe is bodily movable.

4. A disconnect switch according to claim 3 wherein said blade switches are operably connected to said interphase support pipe by releasable clamp members.

5. A disconnect switch according to claim 4 wherein there is provided a current conducting aluminum sleeve for each phase switch, said current conducting sleeves being mounted on said interphase support pipe but not in contact with each other and in a position of cooperation with an associated phase switch;
   said interphase support pipe being carried by a pivotal hinge clamp which is pivotally secured to a hanger member that is secured to said frame; and said releasable clamp members are also clamped to associated ones of said current conducting sleeves;

whereby said blade witches are clamped in operative position to said interphase pipe and are also clamped to an associated current conducting sleeve and said current conducting sleeves are clamped in an associated pivotal hinge clamp to thereby provide a continuous current path when said blade switches are in their cloed position from said fixed contacts to said frame and said interphase support pipe serves as a counterbalance to said blade switches.

6. A disconnect switch according to claim 5 wherein said clamp members are provided with a pair of spaced apart elongated keyways that extend parallel to the interphase support pipe; and a bar key in each of said keyways constructed and arranged to extend outwardly of their associated keyways so that a corner of each bar key bites into the surface of the member which is being clamped therein on a line contact therewith to prevent said members from moving angularly relative to said associated clamp members.

7. In a ground switch;

a supporting frame;

an insulator carried by said frame;

a fixed contact carried by said insulator;

a blade switch movable into and out of engagement with said fixed contact; and support shaft carried by said frame and having a pivot axis for supporting said blade switch in a manner to move said blade switch bodily about the pivot axis into and out of engagement with said fixed contact.

8. A ground switch according to claim 7 wherein said blade switch is carried by said support shaft in a manner that the pivot axis about which said blade switch is bodily movable is located between said frame and said blade switch.

9. A ground switch according to claim 8 wherein said support shaft includes a clamp means connected to swing about said pivot axis; and said blade switch is carried by said clamp means in a manner that the mass moving about the pivot axis serves as a counterbalance.

10. In a releasable clamp for a tubular member;

a first body having a semi-circular concave recess therein and provided with laterally extending portions;

a second body having a semi-circular concave recess therein complementary to the semi-circular concave recess of said first body, said second body having laterally extending portions which align with the laterally extending portions of said first body when said first and second bodies are disposed with their semi-circular concave recesses facing each other;

a pair of keyways formed in spaced apart relationship in the surface of the semi-circular concave recess of one of said bodies;

a key in each keyway, said keys each presenting a relatively sharp edge portion that extends beyond the surface of the concave recess in which the keyways are formed, said sharp edge portion of each key being adapted to make line contact engagement with the surface of a tubular member clamped between said first and second bodies; and means extending through the laterally extending portions of said first and second bodies to forcefully urge said first and second bodies towards each other to effectively clamp the tubular member therein;

whereby the sharp edges of said keys make line contact with the surface of a tubular member to effectively prevent inadvertant angular movement of the tubular member within said clamp.

* * * * *